US009782629B2

(12) United States Patent
Nardacci et al.

(10) Patent No.: US 9,782,629 B2
(45) Date of Patent: Oct. 10, 2017

(54) CURVILINEAR GOLF BALL DIMPLES AND METHODS OF MAKING SAME

(71) Applicant: Acushnet Company, Fairhaven, MA (US)

(72) Inventors: Nicholas M. Nardacci, Marion, MA (US); Michael R. Madson, Wrentham, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/941,916

(22) Filed: Nov. 16, 2015

(65) Prior Publication Data

US 2017/0136303 A1 May 18, 2017

(51) Int. Cl.
*A63B 37/00* (2006.01)

(52) U.S. Cl.
CPC ..... *A63B 37/0006* (2013.01); *A63B 37/0004* (2013.01); *A63B 37/0007* (2013.01); *A63B 37/0008* (2013.01); *A63B 37/0009* (2013.01)

(58) Field of Classification Search
CPC ..... A63B 37/0004; A63B 37/0007; A63B 37/0008; A63B 37/0009
See application file for complete search history.

(56) References Cited

U.S. PATENT DOCUMENTS 5,377,989 A * 1/1995 Machin ..... A63B 37/0004 40/327
5,566,943 A 10/1996 Boehm ..... 473/384
6,019,688 A * 2/2000 Sullivan ..... A63B 37/0004 473/383
6,231,463 B1 * 5/2001 Tavares ..... A63B 37/0004 473/378
6,729,976 B2 5/2004 Bissonnette et al. ..... 473/383
6,796,912 B2 9/2004 Dalton et al. ..... 473/383
8,029,388 B2 10/2011 Nardacci et al. ..... 473/409
2003/0158002 A1 * 8/2003 Morgan ..... A63B 37/0004 473/383
2005/0009644 A1 * 1/2005 Aoyama ..... A63B 37/0004 473/378
2005/0266934 A1 12/2005 Morgan et al. ..... 473/383
2006/0068939 A1 * 3/2006 Sato ..... A63B 37/0004 473/378
2012/0165130 A1 6/2012 Madson et al. ..... 473/384
2012/0302378 A1 * 11/2012 Sato ..... A63B 37/0006 473/384
2013/0065708 A1 3/2013 Hixenbaugh et al. ..... 473/379
2013/0172123 A1 7/2013 Nardacci et al. ..... 473/383
2014/0135146 A1 * 5/2014 Madson ..... A63B 37/0006 473/383

* cited by examiner

*Primary Examiner* — John E Simms, Jr.

(74) *Attorney, Agent, or Firm* — Smith, Gambrell & Russell, LLP

(57) ABSTRACT

The present invention is directed to golf balls having surface textures with unique appearances and improved aerodynamic characteristics due, at least in part, to the use of curvilinear dimple plan shapes. In particular, the present invention is directed to a golf ball that includes at least a portion of its dimples having a plan shape defined by a number of convex or concave arcs that are derived from the vertices of a regular n-sided polygon.

25 Claims, 20 Drawing Sheets

CURVILINEAR GOLF BALL DIMPLES AND METHODS OF MAKING SAME

FIELD OF THE INVENTION

The present invention relates to golf ball dimples having a curvilinear plan shape defined by circular arcs. In particular, the present invention relates to golf ball dimples having plan shapes defined by a number of convex or concave arcs derived from a regular n-sided polygon. When utilized on golf balls, the golf ball dimples of the present invention provide surface textures with unique appearances, while maintaining desirable aerodynamic characteristics.

BACKGROUND OF THE INVENTION

Golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through air.

Aerodynamic forces acting on a golf ball are typically resolved into orthogonal components of lift ($F_L$) and drag ($F_D$). Lift is defined as the aerodynamic force component acting perpendicular to the flight path. It results from a difference in pressure that is created by a distortion in the air flow that results from the back spin of the ball. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Drag is defined as the aerodynamic force component acting opposite to the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. The air separates from the surface of the ball, leaving a large turbulent flow area with low pressure, i.e., the wake. The difference between the high pressure in front of the ball and the low pressure behind the ball reduces the ball speed and acts as the primary source of drag.

Lift and drag, among other aerodynamic characteristics of a golf ball, are influenced by the external surface geometry of the ball, which includes the dimples thereon. As such, the dimples on a golf ball play an important role in controlling those parameters.

Recently, a number of golf ball products in the market place have been introduced with golf ball surfaces featuring visually distinct dimple patterns. Golf balls featuring these visually distinct dimple patterns are most prevalent in the premium distance category. Existing examples of such golf balls include, but are not limited to, the Dunlop XXiO XD Aero, the Bridgestone Tourstage PHYZ, and the Saso Kaede. While these golf ball designs possess a unique visual appearance, the dimple patterns utilized on the golf balls, when compared to conventional dimple patterns, are less aerodynamically efficient.

Other unique dimple designs have also been introduced. For example, isodiametrical dimples, such as those disclosed in U.S. Pat. No. 5,377,989, provide for visually distinct dimple shapes. However, due to the nature of the curvatures in forming the isodiametric shape, these dimples limit surface coverage uniformity and packing efficiency when utilized on golf balls. Accordingly, there remains a need for a dimple geometry that provides a visually distinct golf ball surface texture, while providing improved aerodynamic characteristics and maximized packing efficiency.

SUMMARY OF THE INVENTION

The present invention is directed to a golf ball having a substantially spherical surface, including a plurality of dimples on the spherical surface, wherein at least a portion of the plurality of dimples, for example, about 50 percent or more, include a curvilinear plan shape defined by at least 3 circular arcs, wherein each circular arc includes two endpoints that define adjacent vertices of a regular polygon. In one embodiment, the curvilinear plan shape is defined by 3 to 12 circular arcs. In another embodiment, the regular polygon is an equilateral polygon comprising from 3 to 12 sides. In still another embodiment, the number of circular arcs is equivalent to the number of sides of the regular polygon. The circular arcs may include concave arcs, convex arcs, or combinations thereof. For example, the plan shape may be defined by an even number of alternating convex and concave circular arcs less than or equal to 12. In yet another embodiment, the portion of the plurality of dimples has a plan shape area ratio of about 0.35 to about 1.75.

The present invention is also directed to a golf ball having a substantially spherical surface, including a plurality of dimples on the spherical surface, wherein at least a portion of the plurality of dimples, for example, about 70 percent or more, include a curvilinear plan shape defined by a plurality of arc segments having endpoints that define adjacent vertices of a polygon including n sides, wherein each arc segment includes an arc center outside of the polygon, and wherein the plurality of arc segments is equal to n. In one embodiment, n ranges from 3 to 12, and more preferably, from 3 to 8. In another embodiment, the plurality of arc segments has identical lengths and radii. Conversely, the arc segments may each have a different length and radius. In still another embodiment, the plurality of arc segments includes both concave and convex circular arcs. For example, the plan shape may be defined by alternating convex and concave circular arcs. In yet another embodiment, the portion of the plurality of dimples has a plan shape perimeter ratio of less than 1.10.

The present invention is further directed to a golf ball dimple having a perimeter defined by a plurality of convex or concave circular arcs having identical lengths and radii, wherein each circular arc has two endpoints that define consecutive vertices of a regular n-sided polygon. In one embodiment, the perimeter of the dimple is defined by at least 3 circular arcs, for example, 3 to 12 circular arcs. In this aspect, the perimeter may be defined by a plurality of concave circular arcs and a plurality of convex circular arcs. In another embodiment, the regular n-sided polygon is selected from the group consisting of triangles, squares, pentagons, hexagons, heptagons, octagons, nonagons, decagons, hendecagons, and dodecagons.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
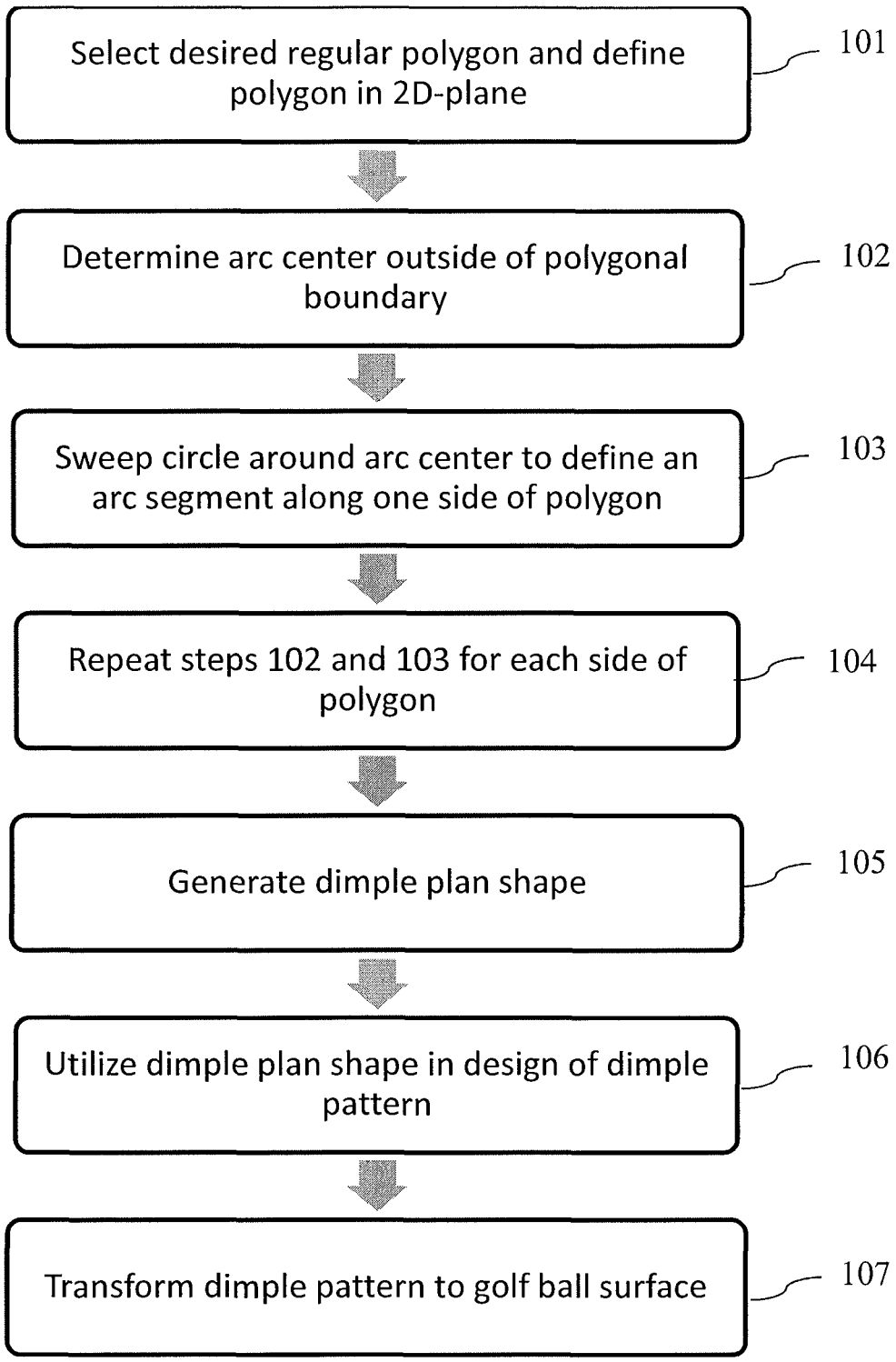
FIG. 1 is a flowchart illustrating the steps according to a method of forming a dimple plan shape of the present invention.

The present invention is directed to golf balls having surface textures with unique appearances and improved aerodynamic characteristics due, at least in part, to the use of noncircular dimple plan shapes. In particular, the present invention is directed to a golf ball that includes at least a portion of its dimples having a curvilinear plan shape defined by a number of convex or concave arcs that are derived from a regular n-sided polygon.

Advantageously, in one embodiment, golf balls including dimple plan shapes produced in accordance with the present invention have visually distinct surface textures. Indeed, the dimple plan shapes of the present invention possess a unique visual appearance. In another embodiment, the dimple plan shapes of the present invention allow the dimples to be arranged according to spherically tiled dimple designs. The spherical tiling layouts utilizing the dimple plan shapes of the present invention provide improved symmetry including multiple axes of symmetry on each golf ball. As a result, golf balls including the dimple plan shapes of the present invention exhibit improved aerodynamic performance in addition to providing visually distinct dimple patterns.

Dimple Plan Shape

A dimple plan shape, as used herein, refers to the perimeter of the dimple as seen from a top view of the dimple, or the demarcation between the dimple and the outer surface of the golf ball or fret surface. The present invention contemplates dimples having a curvilinear plan shape.

The present invention contemplates curvilinear dimple plan shapes defined by circular arcs that form a simple closed path. A "simple closed path," as used herein, includes one that starts and ends at the same point without traversing any defining point or edge along the path more than once. In particular, the dimple plan shapes of the present invention include a number of convex or concave circular arcs having endpoints that define the vertices of a regular n-sided polygon. That is, the plan shapes of the present invention are defined by arc segments created from a regular n-sided polygon. Indeed, the present invention contemplates non-smooth plan shapes having discontinuities at the endpoints of each arc segment.

The present invention contemplates plan shapes defined by a plurality of arc segments that are derived from the sides of a regular n-sided polygon. In one embodiment, the arc segments are created by arcs of circles centered outside of a regular polygon. As discussed in greater detail below, the location of the centers of the circles is dependent on whether the number of sides of the polygon is odd or even. For example, when the number of sides of the polygon is even, the centers of the circles lie on an axis defined by the center of the polygonal inradius and the side mid-point. In another embodiment, when the number of sides of the polygon is odd, the centers of the circles lie on an axis defined by the center of the polygonal inradius and the vertex. Indeed, the circular arcs are designed to sweep the sides of the regular polygon such that arc segments are created between each vertex of the regular polygon in a convex or concave manner.

In one embodiment, the plan shape may be defined by a plurality of convex arcs. For example, the plan shape may include a plurality of arc segments that curve in an outwardly direction. In another embodiment, the plan shape may be defined by a plurality of concave arcs. For example, the plan shape may include a plurality of arc segments that curve in an inwardly direction.

In still another embodiment, the plan shape may be defined by a combination of convex and concave arcs. For example, the plan shape may include one or more convex arcs and one or more concave arcs such that each arc segment is created between each vertex of the regular polygon in a concave or convex manner.

In yet another embodiment, the plan shape may be defined by alternating convex and concave arcs. For example, the plan shape may include a plurality of arc segments that alternate between convex arcs and concave arcs. In this embodiment, the number of sides of the polygon is even.

The number of arc segments is equivalent to the number of sides of the regular polygon. For example, a plan shape including three arc segments may correspond to a three-sided polygon or a triangle. In another embodiment, a plan shape including four arc segments may correspond to a four-sided polygon or a square. In still another embodiment, a plan shape including five arc segments may correspond to a five-sided polygon or a pentagon. In yet another embodiment, a plan shape including six arc segments may correspond to a six-sided polygon or a hexagon.

In this aspect, the present invention contemplates any regular n-sided polygon. By the term, "regular n-sided polygon," it is meant a polygon that is equiangular (i.e., all angles are equal in measure) and equilateral (i.e., all sides have the same length). In one embodiment, the present invention contemplates regular n-sided polygons, where n is equal to or greater than 3. Indeed, the present invention contemplates regular polygons having at least 3 or more equal length sides. While polygons having a higher number of sides may be employed, increasing the number of sides produces plan shapes which closely approximate a circular perimeter. Thus, it is preferable to utilize polygons having smaller values of n.

For example, the present invention contemplates regular n-sided polygons having from 3 to about 50 equal length sides. In another embodiment, the polygon of the present invention has from 3 to about 26 equal length sides. In still another embodiment, the polygon of the present invention has from 3 to about 12 equal length sides. In yet another embodiment, the polygon of the present invention has from 3 to about 8 equal length sides.

Suitable examples of regular n-sided polygons contemplated by the present invention include, but are not limited to, triangles, squares, pentagons, hexagons, heptagons, octagons, nonagons, decagons, hendecagons, and dodecagons.

The overall dimensions of the regular n-sided polygon may vary. In this aspect, the dimensions of the polygon may be defined by the length of the sides of the polygon. As noted above, the polygons of the present invention are equilateral (i.e., all sides have the same length). In one embodiment, the length of each side of the polygon ranges from about 0.085 inches to about 0.260 inches. For example, the length of each side may range from about 0.100 inches to about 0.250 inches. In another embodiment, the length of each side may range from about 0.125 inches to about 0.225 inches. In still another embodiment, the length of each side may range from about 0.150 inches to about 0.200 inches.

In another embodiment, the dimensions of the polygon may be defined by the inradius of the regular polygon. For purposes of the present invention, the term, "inradius," refers to the radius of a polygon's incircle, or the radius of the largest circle that fits inside of the polygon and is tangent with each side. The inradius of a regular polygon with n sides and side length a is given by equation (1), denoted below:

$$r = \frac{1}{2} a \cot\left(\frac{\pi}{n}\right). \quad (1)$$

In this aspect, the present invention contemplates regular polygons having an inradius of about 0.025 inches to about 0.150 inches. For example, the polygon of the present invention may have an inradius of about 0.050 inches to about 0.125 inches. In another embodiment, the polygon of the present invention may have an inradius of about 0.075 inches to about 0.115 inches. In still another embodiment, the polygon of the present invention may have an inradius of about 0.080 inches to about 0.100 inches.

In still another embodiment, the dimensions of the polygon may be defined by the circumradius of the regular polygon. For purposes of the present invention, the term, "circumradius," refers to the radius of the polygon's circumcircle, or the radius of the circle that passes through each vertex of the regular polygon. Indeed, the circumradius will approach the inradius as n approaches infinity. For example, when n=3, the circumradius is twice the inradius.

In this aspect, the present invention contemplates regular polygons having a circumradius of about 0.050 inches to about 0.300 inches. For example, the polygon of the present invention may have a circumradius of about 0.075 inches to about 0.275 inches. In another embodiment, the polygon of the present invention may have a circumradius of about 0.100 inches to about 0.250 inches. In still another embodiment, the polygon of the present invention may have a circumradius of about 0.125 inches to about 0.225 inches. In yet another embodiment, the polygon of the present invention may have a circumradius of about 0.150 inches to about 0.200 inches.

The length and radii of the curvature of each arc segment will vary based on the selected dimensions of the regular n-sided polygon. However, in one embodiment, the arc segments of the plan shape have equal curvatures. That is, each arc of the plan shape has an identical length and radii. In another embodiment, the arc segments of the plan shape have different lengths and radii. For instance, each arc segment may have a different radii. In still another embodiment, at least one of the arc segments may have different radii.

Figure 2:
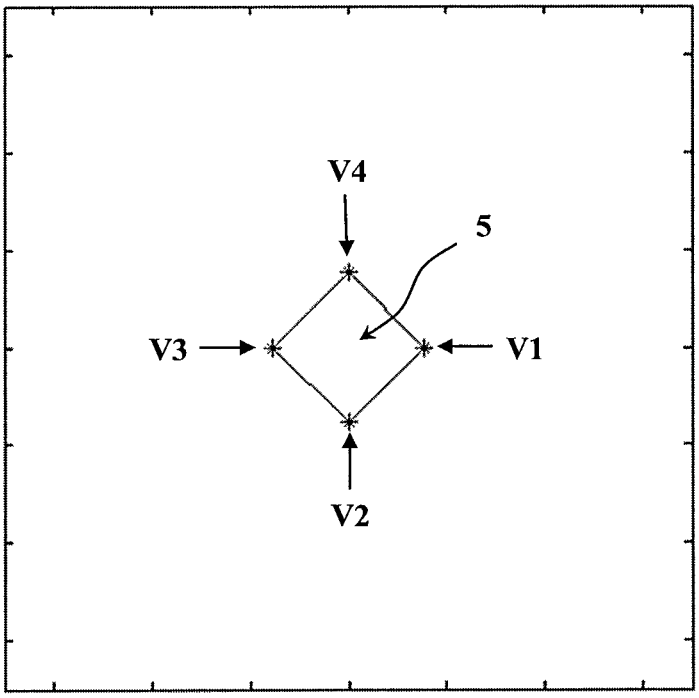
FIG. 2 illustrates a regular polygon defined in a two-dimensional plane according to one embodiment of the present invention.

FIG. 1 illustrates one embodiment of a method of forming a dimple plan shape in accordance with the present invention. For example, step 101 includes selecting the regular polygon and its overall dimensions, and defining the regular polygon in a two-dimensional plane. Indeed, any of the regular n-sided polygons discussed above are contemplated in this aspect of the present invention. In one embodiment, the dimensions of the regular polygon may be defined by specifying the length of each side of the polygon. In another embodiment, the dimensions of the polygon may be defined by specifying the inradius or circumradius of the regular polygon. However, the dimensions of the polygon, including the length of each side, the inradius, and the circumradius, should be selected such that the values are in accordance with the parameters discussed above. FIG. 2 illustrates a regular polygon defined in a two-dimensional plane. As shown in FIG. 2, the regular polygon 5 has four equal sides that meet at four vertices, $V_1$, $V_2$, $V_3$, and $V_4$. The four-sided regular polygon 5 is referred to, hereinafter, as a square.

Once the base polygon is chosen, each arc segment is constructed. According to the present invention, the number of arc segments is equivalent to the number of sides of the regular polygon. For example, if the regular polygon has four sides, the plan shape of the present invention will be defined by four arc segments. To construct the first arc segment, an arc center is determined (step 102). The arc center, C, may be defined as any point lying outside the polygonal boundary. Indeed, each arc center should lie outside the convex hull of the base polygon.

In this aspect, the location of the arc center, C, will vary depending on the number of sides of the polygon. For example, when the number of sides of the polygon is even, the arc center lies on an axis that extends radially from the polygonal incenter and bisects the side of the polygon connecting the adjacent vertices. In another embodiment, when the number of sides of the polygon is odd, the arc center lies on an axis that extends radially from the polygonal incenter and through the vertex.

After the arc center has been defined, at step 103, an arc is swept around the arc center to create a circle. In one embodiment, the circle should sweep one side of the regular polygon such that an arc segment is defined having endpoints at two consecutive vertices of the polygon. In this regard, to ensure that the circle sweeps the interior or exterior of a side of the polygon, the radius, r, of the circle should, at a minimum, be greater than twice the circumradius, $r_c$, of the selected polygon. For example, the radius, r, of the circle should satisfy the following inequality, denoted as equation (2) below:

$$2r_c < r < 2r_c * \left(\frac{\alpha * \sin(\pi/n)}{\sqrt{n^\beta}} + 1\right), \tag{2}$$

where constants, $\alpha$ and $\beta$, define the upper bound on the radius. In one embodiment, $\alpha$ is a value between about 50 and about 100, while $\beta$ is a value between about 2 and about 4.

Figure 3:
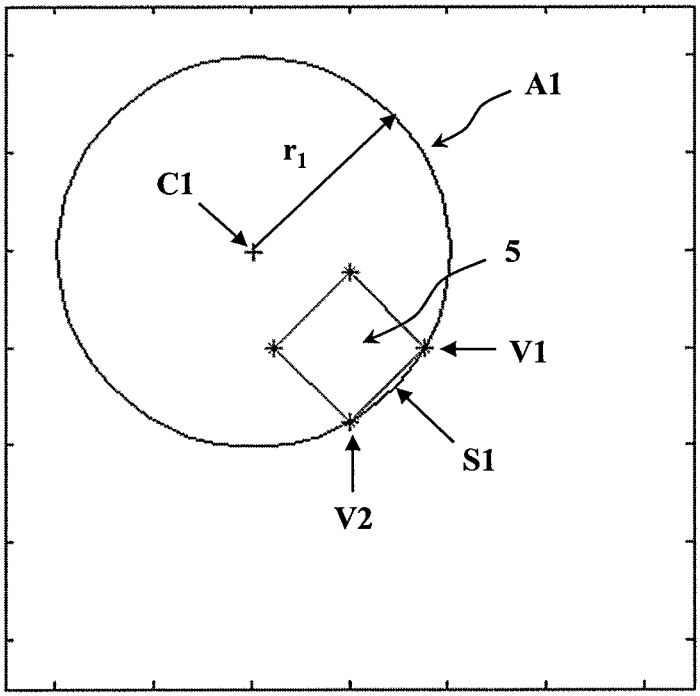
FIG. 3 illustrates a defined first convex arc segment and associated center point of the circle that defines an arc segment along a side of the regular polygon of FIG. 2 according to one embodiment of the present invention.

FIG. 3 demonstrates a defined first arc segment and associated center point using the square 5 as the regular polygon. For example, the arc center, C1, is defined as a point lying outside the boundary of the square 5. The radius, $r_1$, of the circle, A1, is determined such that the radius is at least twice the circumradius of the square 5 and satisfies the inequality of equation (2). The circle, A1, is swept around the arc center, C1, such that the circle sweeps one side of the square 5. As a result, arc segment, S1, is defined such that its endpoints are at consecutive vertices, $V_1$ and $V_2$, of the square 5.

Steps 102 and 103, as described above, are repeated for each arc segment of the plan shape (step 104). Indeed, an arc segment should be constructed for each side of the selected regular polygon. In this aspect, the remaining arc centers should be defined around the regular polygon such that each side of the polygon is utilized in constructing an arc segment.

Figure 4A:
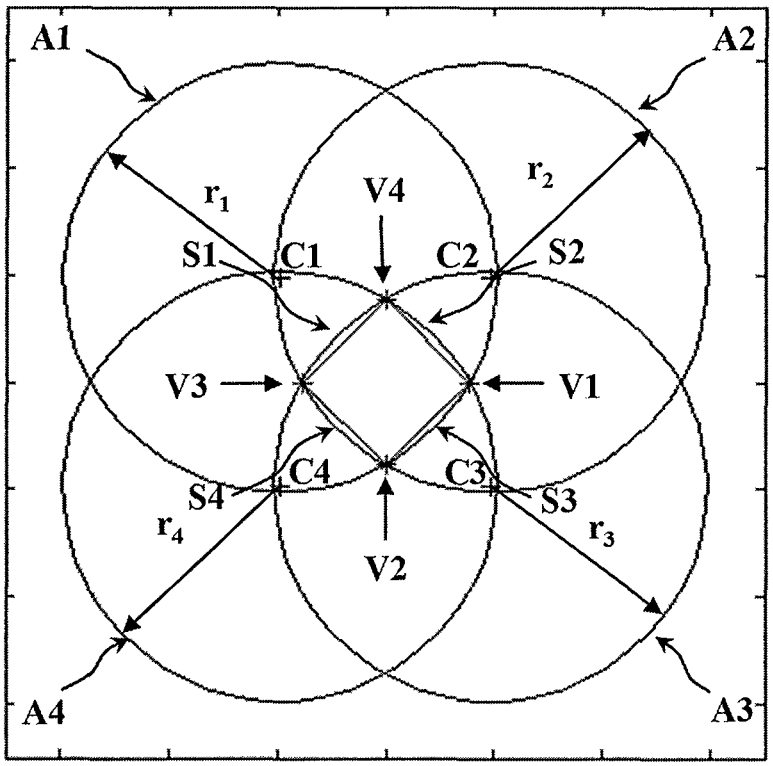
FIG. 4A illustrates all defined convex arc segments and associated center points of the circles that define arc segments along each side of the polygon of FIG. 2 according to one embodiment of the present invention.

For example, FIG. 4A shows all four defined arc segments and associated center points of the square 5. As shown in FIG. 4A, the arc center, C2, is defined as a point lying outside the boundary of the square polygon. The radius, $r_2$, of the circle, A2, is determined such that the radius is at least twice the circumradius of the square 5 and satisfies the inequality of equation (2). The circle, A2, is swept around the arc center, C2, to define arc segment, S2, having endpoints at consecutive vertices, $V_2$ and $V_3$, of the square.

Similarly, the arc center, C3, is defined as a point lying outside the boundary of the square polygon. The radius, $r_3$, of the circle, A3, is determined such that the radius is at least twice the circumradius of the square 5 and satisfies the inequality of equation (2). The circle, A3, is swept around the arc center, C3, to define arc segment, S3, having endpoints at consecutive vertices, $V_3$ and $V_4$, of the square.

Further, arc center, C4, is defined as a point lying outside the boundary of the square polygon. The radius, $r_4$, of the circle, A4, is determined such that the radius is at least twice the circumradius of the square 5 and satisfies the inequality of equation (2). The circle, A4, is swept around the arc center, C4, to define arc segment, S4, having endpoints at consecutive vertices, $V_4$ and $V_1$, of the square. In this embodiment, the circles, the radii, the arc segments, and the Euclidean distance of the arc centers from the incenter of the polygon, are equivalent.

As discussed briefly above, the arc segments of the present invention may be convex or concave. In this aspect of the invention, the location of the arc center relative to the arc will determine whether the arc segment is convex or concave. For example, when forming a convex arc, the arc center should lie on the side opposite to the side of the polygon where the convex arc segment is formed. Conversely, when forming a concave arc, the arc center should lie on the same side as the side of the polygon where the concave arc segment is formed.

Figure 4B:
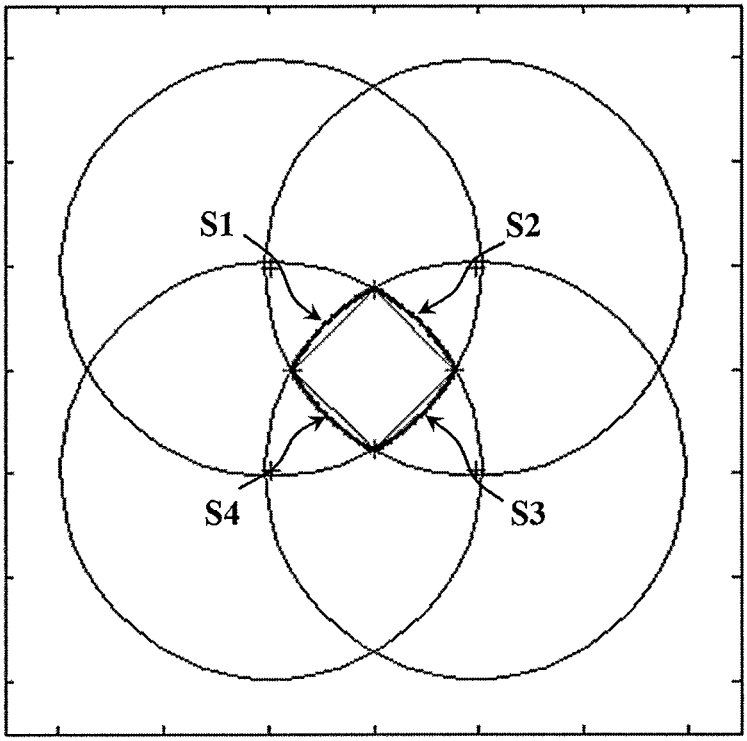
FIG. 4B illustrates all defined arc segments of FIG. 4A as convex arcs according to one embodiment of the present invention.

FIGS. 2-4B demonstrate the use of convex arc segments. Indeed, FIG. 3 shows the arc center C1 positioned on the side opposite to the side of the polygon where the convex arc segment will be formed (i.e., between V1 and V2). FIG. 4B exemplifies arc segments, S1-S4, as convex arcs.

Figure 5:
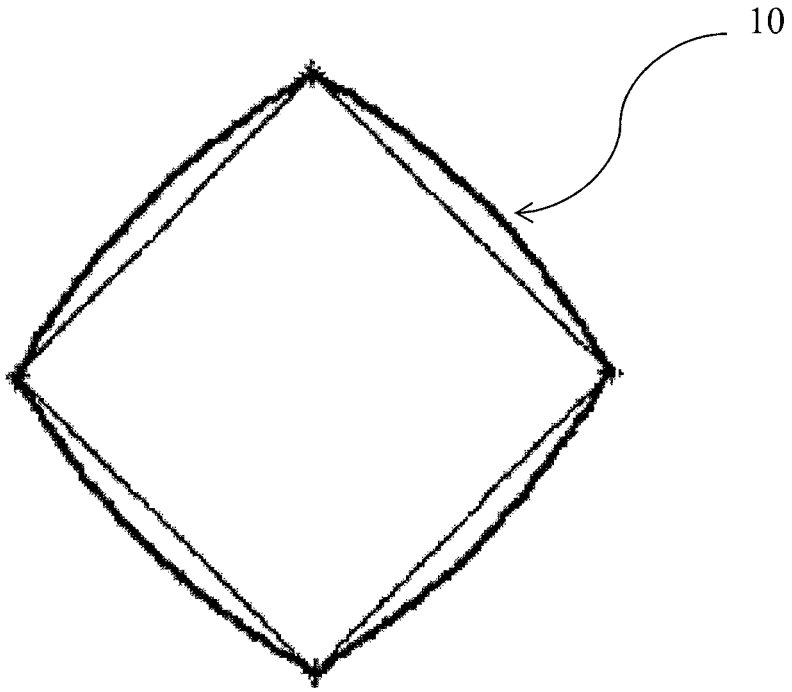
FIG. 5 illustrates a dimple plan shape constructed from the arc segments of FIGS. 4A-B according to one embodiment of the present invention.

After each of the arc segments are constructed, the dimple plan shape of the present invention is generated (step 105). FIG. 5 shows the final dimple plan shape constructed from arc segments, S1-S4, defined in FIG. 4B. In particular, FIG. 5 illustrates a curvilinear dimple plan shape 10 (represented by bold line) contemplated by the present invention. Specifically, FIG. 5 shows a convex dimple plan shape defined by circular arc segments and created from a square (4-sided polygon). As can be seen by the constructed curvilinear dimple plan shape of FIG. 5, the present invention contemplates non-smooth plan shapes having discontinuities at the endpoints of each arc segment. Indeed, the discontinuity at each end point is maintained after constructing the arcs such that the resulting plan shape is non-isodiametrical in nature.

Figure 6:
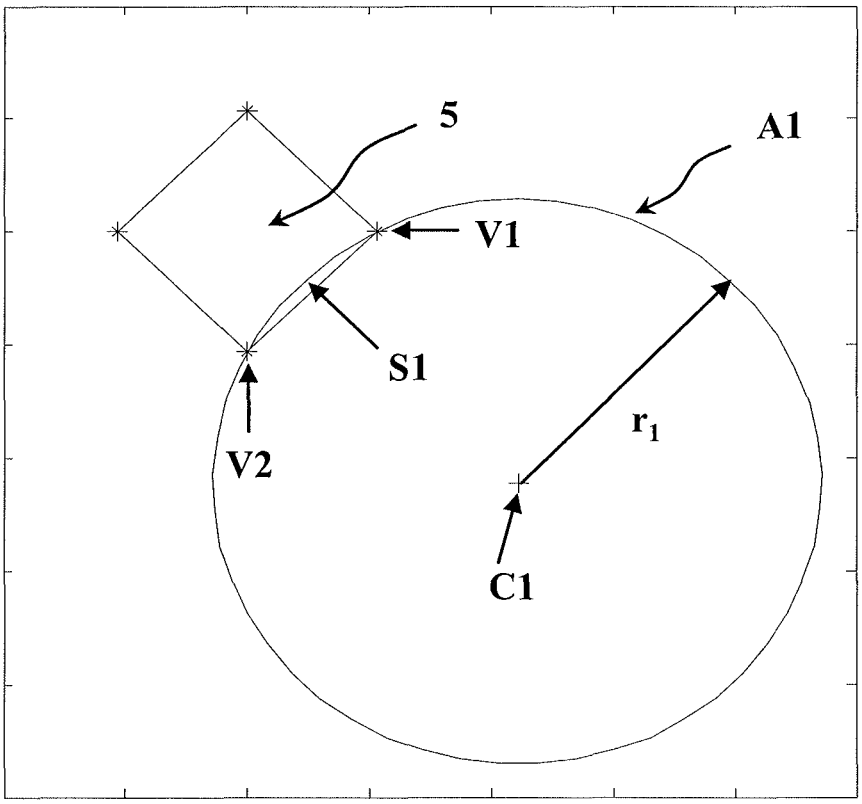
FIG. 6 illustrates a defined first concave arc segment and associated center point of the circle that defines an arc segment along a side of the regular polygon of FIG. 2 according to one embodiment of the present invention.
Figure 7A:
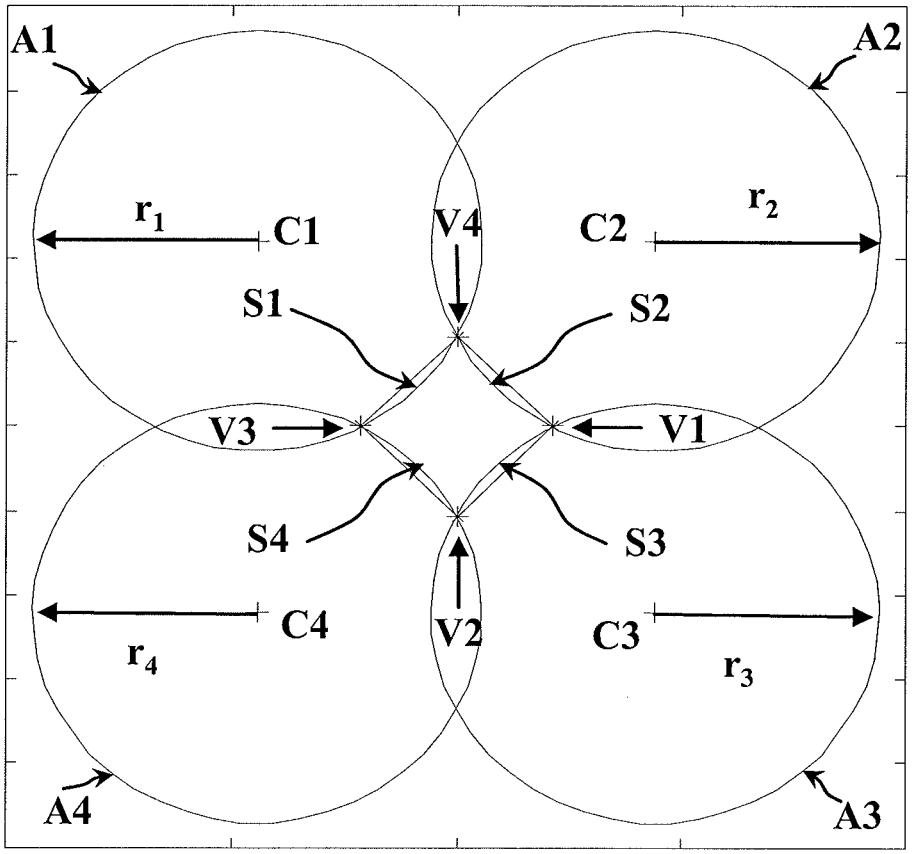
FIG. 7A illustrates all defined concave arc segments and associated center points of the circles that define arc segments along each side of the regular polygon of FIG. 2 according to one embodiment of the present invention.
Figure 7B:
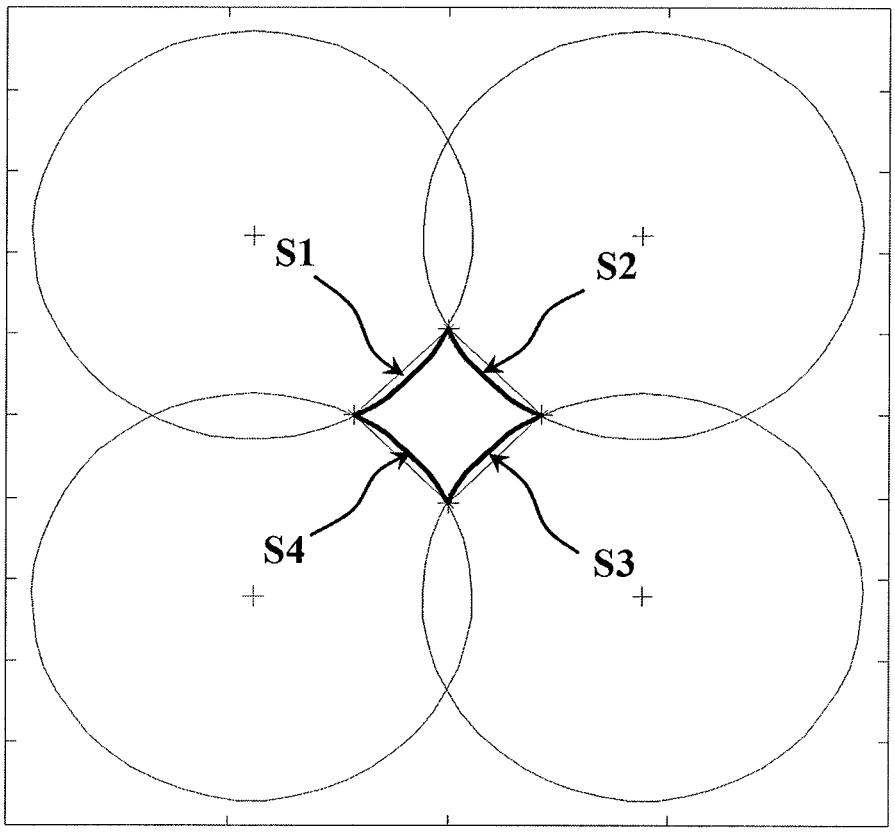
FIG. 7B illustrates all defined arc segments of FIG. 7A as concave arcs according to one embodiment of the present invention.
Figure 8:
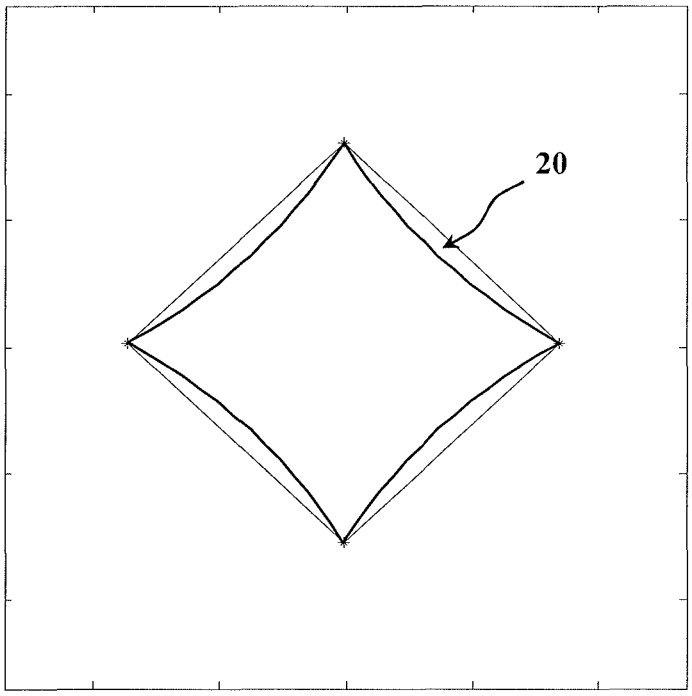
FIG. 8 illustrates a dimple plan shape constructed from the arc segments of FIG. 7A-B according to one embodiment of the present invention.

The process described above in FIG. 1 is also applicable to forming a dimple plan shape having concave arc segments. For example, steps 102-105 may be adjusted for the concave nature of the arc. FIGS. 6-8, discussed in more detail below, exemplify the process of FIG. 1 for forming dimple plan shapes having concave arc segments in accordance with the present invention.

As discussed above, step 101 includes selecting the regular polygon and its overall dimensions, and defining the regular polygon in a two-dimensional plane. For illustrative purposes, the square 5 having four equal sides that meet at four vertices, $V_1$, $V_2$, $V_3$, and $V_4$ (as shown in FIG. 2) will be used.

To construct the first arc segment, an arc center is determined (step 102). In this embodiment, since the number of sides of the polygon is even, the arc center should lie on an axis that extends radially from the polygonal incenter and through the vertex. Additionally, because a concave arc segment is contemplated, the arc center should lie on the same side as the side of the polygon where the concave arc segment is formed. For example, as shown in FIG. 6, the arc center C1 lies on the same side as the side of the polygon where the first concave arc segment will be formed (i.e., between V1 and V2).

FIG. 6 demonstrates a defined first concave arc segment and associated center point using the square 5 as the regular polygon. For example, the arc center, C1, is defined as a point lying outside the boundary of the square 5, but on the same side of S1. The radius, $r_1$, of the circle, A1, is determined such that the radius is at least twice the circumradius of the square 5 and satisfies the inequality of equation (2). The circle, A1, is swept around the arc center, C1, such that the circle sweeps one side of the square 5. As a result, concave arc segment, S1, is defined such that its endpoints are at consecutive vertices, $V_1$ and $V_2$, of the square 5.

Steps 102 and 103, as described above, are repeated for each arc segment of the plan shape (step 104). Indeed, an arc segment should be constructed for each side of the selected regular polygon. In this aspect, the remaining arc centers should be defined around the regular polygon such that each side of the polygon is utilized in constructing an arc segment. For example, FIG. 7A shows all four defined concave arc segments and associated center points of the square 5. As shown in FIG. 7A, the arc center, C2, is defined as a point lying outside the boundary of the square polygon, but located on the same side as S2. The radius, $r_2$, of the circle, A2, is determined such that the radius is at least twice the circumradius of the square 5 and satisfies the inequality of equation (2). The circle, A2, is swept around the arc center, C2, to define arc segment, S2, having endpoints at consecutive vertices, $V_2$ and $V_3$, of the square.

Similarly, the arc center, C3, is defined as a point lying outside the boundary of the square polygon, but located on the same side as S3. The radius, $r_3$, of the circle, A3, is determined such that the radius is at least twice the circumradius of the square 5 and satisfies the inequality of equation (2). The circle, A3, is swept around the arc center, C3, to define arc segment, S3, having endpoints at consecutive vertices, $V_3$ and $V_4$, of the square.

Further, arc center, C4, is defined as a point lying outside the boundary of the square polygon, but located on the same side as S4. The radius, $r_4$, of the circle, A4, is determined such that the radius is at least twice the circumradius of the square 5 and satisfies the inequality of equation (2). The circle, A4, is swept around the arc center, C4, to define arc segment, S4, having endpoints at consecutive vertices, $V_4$ and $V_1$, of the square. FIG. 7B exemplifies arc segments, S1-S4, as concave arcs.

After each of the arc segments are constructed, the dimple plan shape of the present invention is generated (step 105). FIG. 8 shows the final dimple plan shape constructed from arc segments, S1-S4, defined in FIG. 7B. In particular, FIG. 8 illustrates a curvilinear dimple plan shape 20 (represented by bold line) contemplated by the present invention. Specifically, FIG. 8 shows a concave dimple plan shape defined by circular arc segments and created from a square (4-sided polygon).

In still another embodiment, the process described above in FIG. 1 may be applicable to designing dimple plan shapes having both concave and convex arc segments. Indeed, the process may be adjusted to design a dimple plan shape having a random combination of both concave and convex arcs. In another embodiment, the process may be adjusted to design a dimple plan shape having alternating convex arcs and concave arcs.

After the dimple plan shape has been generated, at step 106, the plan shape can be used in designing geometries for dimple patterns of a golf ball. For example, the plan shapes generated in accordance with the present invention can be imported into a CAD program and used to define dimple geometries and tool paths for fabricating tooling for golf ball manufacture. The various dimple geometries can then be used in constructing dimple patterns that provide surface textures with unique appearances and improved aerodynamic characteristics.

At step 107, the resulting dimple pattern can be transformed to the outer surface of a golf ball. Similarly, the negative of the resulting dimple pattern may be used to form the interior surface of the cavity of a golf ball mold. For example, the negative of the resulting golf ball dimple pattern can be applied to the interior of a golf ball mold, which can then be used in an injection molding, compression molding, or casting process to form a cover layer comprising the golf ball dimple pattern.

Dimple Patterns & Packing

The golf ball dimples of the present invention may be tailored to maximize surface coverage uniformity and packing efficiency by altering the plan shape of the dimple. For example, in one embodiment, the convex and concave edges of the dimple plan shapes according to the present invention can be designed such that the dimples are packed more closely together to reduce the width of the land portions adjacent to each dimple. In this aspect, each individual dimple may have a different plan shape so that the space between each dimple can be reduced. Thus, the surface edges of the dimples of the present invention allow for maximizing the dimple coverage on the surface of a golf ball by reducing the land portion located between adjacent dimples.

In another embodiment, the golf ball dimple plan shapes of the present invention can be tailored to maximize surface coverage uniformity and packing efficiency by selecting a regular n-sided polygon having a number of sides that is equivalent to the number of neighboring dimples. For example, if the dimple plan shape is constructed using a regular polygon having 5 sides, the present invention contemplates that the dimple will be surrounded by 5 neighboring dimples. In another embodiment, the number of sides of the regular polygon is a scalar multiple of the number of neighboring dimples. For example, if the number of neighboring dimples is 4, the present invention contemplates a dimple plan shape created from a regular polygon having 8 or 12 sides.

Figure 9:
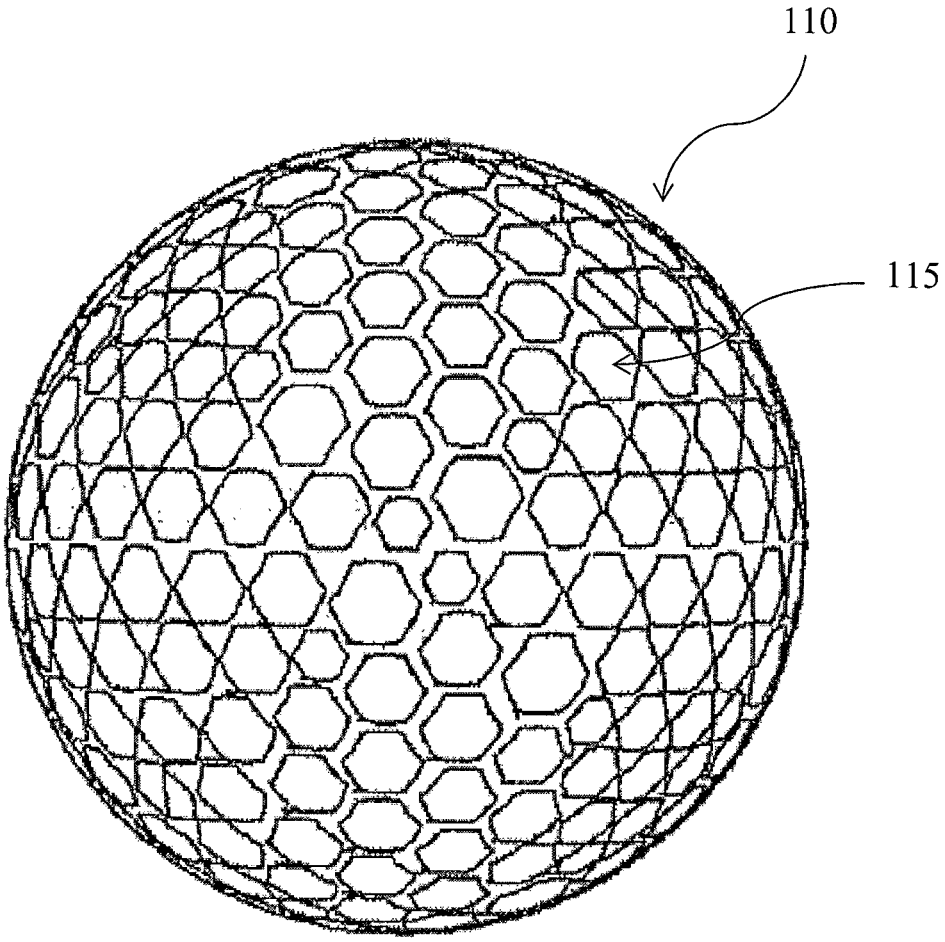
FIGS. 9-11 illustrate various embodiments of golf ball dimple patterns constructed from a plurality of dimple plan shapes according to the present invention.
Figure 10:
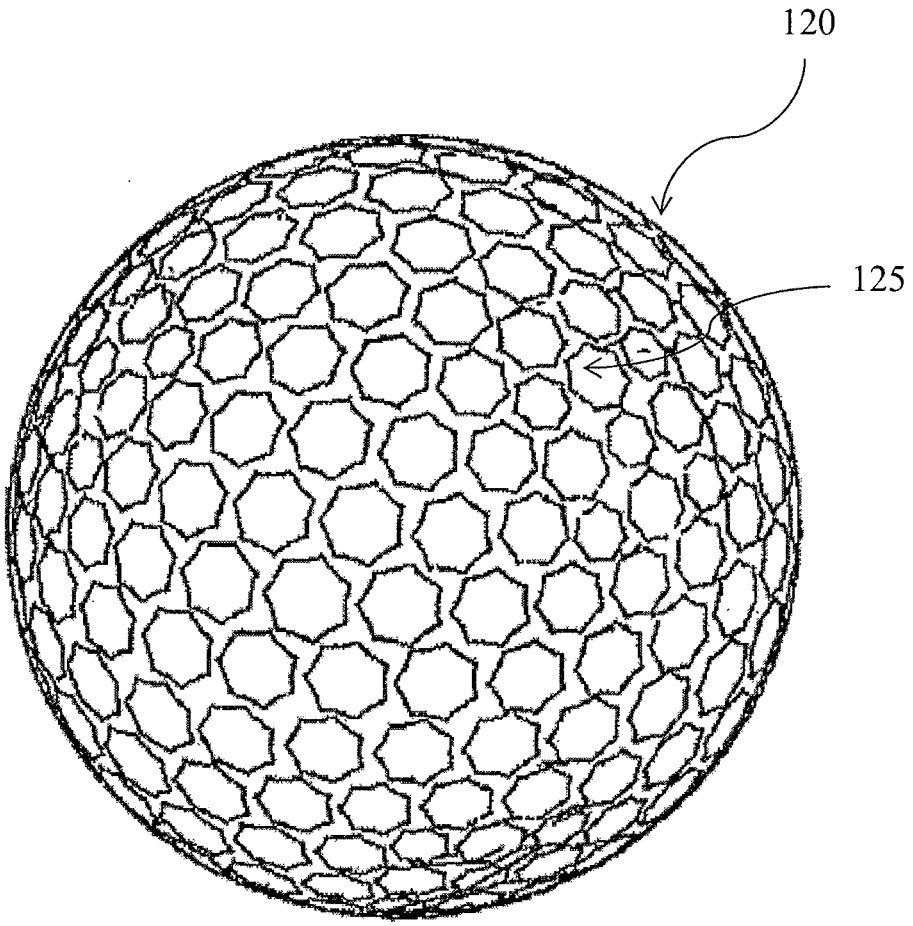
Figure 11:
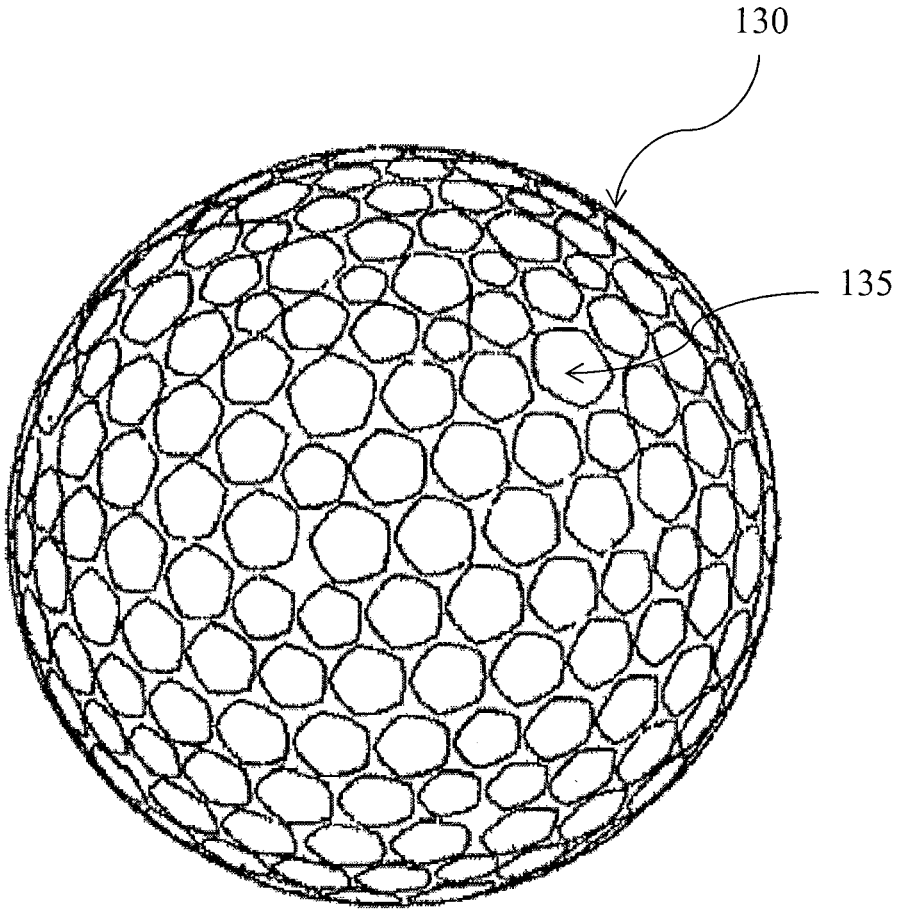

FIGS. 9-11 demonstrate various dimple patterns created in accordance with the present invention. In particular, FIG. 9 illustrates a golf ball dimple pattern 110 made up of hexagonal alternating convex/concave plan shapes 115. Indeed, FIG. 9 illustrates dimple plan shapes 115 defined by alternating convex/concave arcs and created from a 6-sided regular polygon (i.e., hexagon). In addition, FIG. 10 illustrates a golf ball dimple pattern 120 made up of heptagonal concave plan shapes 125. FIG. 10 illustrates dimple plan shapes 125 defined by concave arcs and created from a 7-sided regular polygon (i.e., heptagon). Further, FIG. 11 illustrates a golf ball dimple pattern 130 made up of pentagonal concave plan shapes 135. For example, FIG. 11 shows dimple plan shapes 135 defined by concave arcs and created from a 5-sided regular polygon (i.e., pentagon). As demonstrated in FIGS. 9-11, the present invention provides for the possibility of interdigitation amongst neighboring dimples, a characteristic not possible with conventional circular dimples. This creates the opportunity for additional dimple packing arrangements and dimple distribution on the golf ball surface.

While the dimple plan shapes of the present invention may be used for at least a portion of the dimples on a golf ball, it is not necessary that the dimple plan shapes be used on every dimple of a golf ball. In general, it is preferred that a sufficient number of dimples on the ball are constructed in accordance with the present invention so that the aerodynamic characteristics of the ball may be altered. For example, at least about 30 percent of the dimples on a golf ball include plan shapes according to the present invention. In another embodiment, at least about 50 percent of the dimples on a golf ball include plan shapes according to the present invention. In still another embodiment, at least about 70 percent of the dimples on a golf ball include plan shapes according to the present invention. In yet another embodiment, at least about 90 percent of the dimples on a golf ball include the plan shapes of the present invention. Indeed, 100 percent of the dimples on a golf ball may include the plan shapes of the present invention.

While the present invention is not limited by any particular dimple pattern, dimples having plan shapes according to the present invention are arranged preferably along parting lines or equatorial lines, in proximity to the poles, or along the outlines of a geodesic or polyhedron pattern. Conventional dimples, or those dimples that do not include the plan shapes of the present invention, may occupy the remaining spaces. The reverse arrangement is also suitable.

Suitable dimple patterns include, but are not limited to, polyhedron-based patterns (e.g., tetrahedron, icosahedron, octahedron, dodecahedron, icosidodecahedron, cuboctahedron, and triangular dipyramid), phyllotaxis-based patterns, spherical tiling patterns, and random arrangements. In one embodiment, the dimples are arranged according to a spherical tiling pattern. For example, the dimples of the present invention may be arranged according to spherical tiling patterns described in U.S. Pat. No. 8,029,388 and U.S. Publication No. 2013/0065708, the entire disclosures of which are incorporated by reference herein.

The dimple patterns of the present invention may be of any count. In one embodiment, the dimple count ranges from about 300 to about 400. In another embodiment, the dimple count is about 312. In still another embodiment, the dimple count is about 330, for example, about 332. In yet another embodiment, the dimple count is about 392. In addition, the dimple pattern may include any number of dimple sizes. In one embodiment, the number of dimple sizes range from about 1 to about 30. In another embodiment, the number of dimple sizes range from about 5 to about 20.

Dimple Dimensions

The dimples on the golf balls of the present invention may comprise any width, depth, depth profile, edge angle, or edge radius and the patterns may comprise multitudes of dimples having different widths, depths, depth profiles, edge angles, or edge radii. Since the plan shape perimeters of the present invention are noncircular, the plan shapes are defined by an effective dimple diameter which is twice the average radial dimension of the set of points defining the plan shape from the plan shape centroid. For example, in one embodiment, dimples according to the present invention have an effective dimple diameter within a range of about 0.050 inches to about 0.300 inches. In another embodiment, the dimples have an effective dimple diameter of about 0.100 inches to about 0.250 inches. In still another embodiment, the dimples have an effective dimple diameter of about 0.110 inches to about 0.225 inches. In yet another embodiment, the dimples have an effective dimple diameter of about 0.125 inches to about 0.200 inches.

The surface depth for dimples of the present invention is within a range of about 0.003 inches to about 0.025 inches. In one embodiment, the surface depth is about 0.005 inches to about 0.020 inches. In another embodiment, the surface depth is about 0.006 inches to about 0.017 inches.

The dimples of the present invention have a plan shape perimeter ratio. The plan shape perimeter ratio is defined as the ratio of the plan shape perimeter to that of the regular n-sided polygon perimeter. The perimeter is defined as the distance around a two-dimensional shape, and thus, the length of the boundary line defining the plan shape. In one embodiment, dimples of the present invention have a plan shape perimeter ratio of less than 1.10. In another embodiment, the plan shape perimeter ratio of less than 1.07. In still another embodiment, the plan shape perimeter ratio of less than 1.05.

The dimples of the present invention also have a plan shape area. By the term, "plan shape area," it is meant the area based on a planar view of the dimple plan shape, such that the viewing plane is normal to an axis connecting the center of the golf ball to the point of the calculated surface depth. In one embodiment, dimples of the present invention have a plan shape area ranging from about 0.0025 $in^2$ to about 0.045 $in^2$. In another embodiment, dimples of the present invention have a plan shape area ranging from about 0.005 $in^2$ to about 0.035 $in^2$. In still another embodiment, dimples of the present invention have a plan shape area ranging from about 0.010 $in^2$ to about 0.030 $in^2$.

The dimples of the present invention are further defined to have a plan shape area ratio. The plan shape area ratio is defined as the ratio of the plan shape area to that of the regular n-sided polygon area. In one embodiment, dimples of the present invention have a plan shape area ratio ranging from about 0.35 to about 1.75. In another embodiment, the plan shape area ratio ranges from about 0.40 to about 1.65. In still another embodiment, the plan shape perimeter ratio ranges from about 0.45 to about 1.55.

Figure 12A:
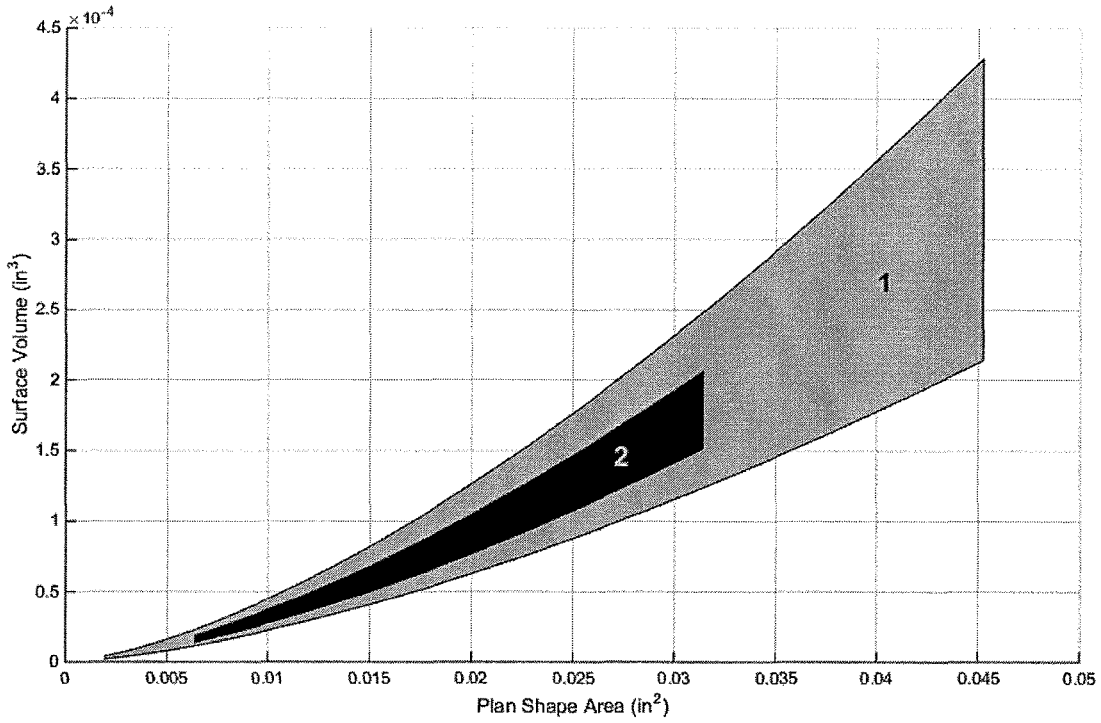
FIG. 12A is a graphical representation illustrating dimple surface volumes for golf balls produced in accordance with the present invention.
Figure 12B:
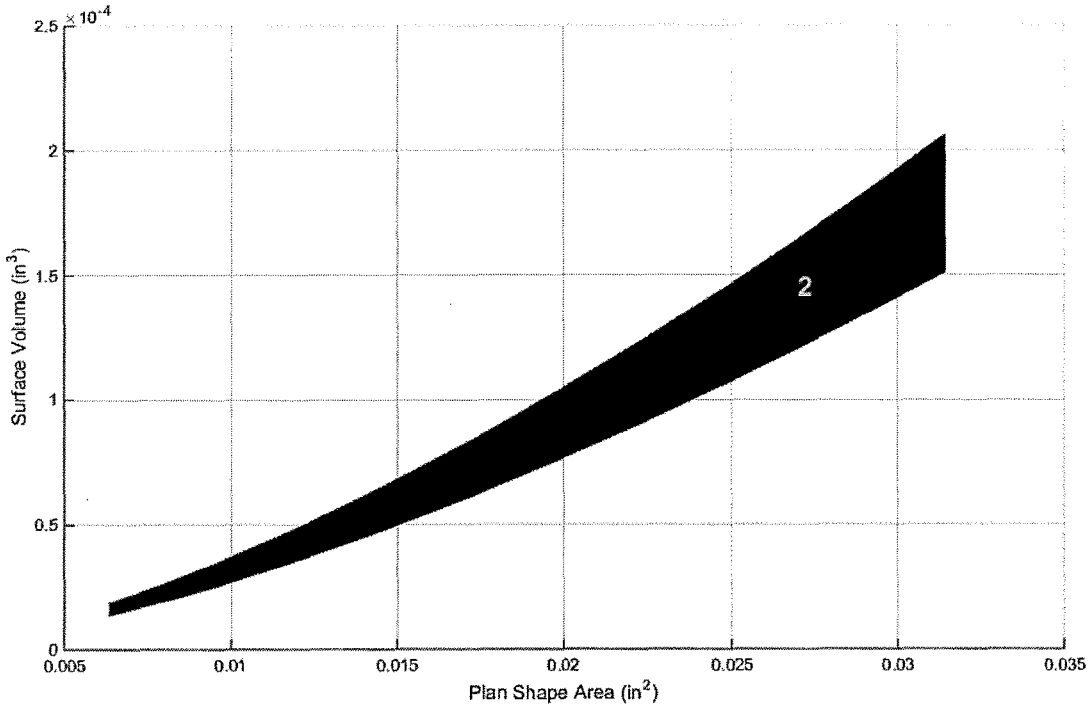
FIG. 12B is a graphical representation illustrating preferred dimple surface volumes for golf balls produced in accordance with the present invention.

Further, dimples of the present invention have a dimple surface volume. By the term, "dimple surface volume," it is meant the total volume encompassed by the dimple shape and the surface of the golf ball. FIGS. 12A and 12B illustrate graphical representations of dimple surface volumes contemplated for dimples produced in accordance with the present invention. For example, FIGS. 12A and 12B demonstrate contemplated dimple surface volumes over a range of plan shape areas. In one embodiment, dimples produced in accordance with the present invention have a plan shape area and dimple surface volume falling within the ranges shown in FIG. 12A. For example, a dimple having a plan shape area of about 0.01 $in^2$ may have a surface volume of about $0.20\times10^{-4}$ $in^3$ to about $0.50\times10^{-4}$ $in^3$. In another embodiment, a dimple having a plan shape area of about 0.025 $in^2$ may have a surface volume of about $0.80\times10^{-4}$ $in^3$ to about $1.75\times10^{-4}$ $in^3$. In still another embodiment, a dimple having a plan shape area of about 0.030 $in^2$ may have a surface volume of about $1.20\times10^{-4}$ $in^3$ to about $2.40\times10^{-4}$ $in^3$. In yet another embodiment, a dimple having a plan shape area of about 0.045 $in^2$ may have a surface volume of about $2.10\times10^{-4}$ $in^3$ to about $4.25\times10^{-4}$ $in^3$.

In another embodiment, dimples produced in accordance with the present invention have a plan shape area and dimple surface volume falling within the ranges shown in FIG. 12B. For example, a dimple having a plan shape area of about 0.01 $in^2$ may have a surface volume of about $0.25\times10^{-4}$ $in^3$ to about $0.35\times10^{-4}$ $in^3$. In another embodiment, a dimple having a plan shape area of about 0.025 $in^2$ may have a surface volume of about $1.10\times10^{-4}$ $in^3$ to about $1.45\times10^{-4}$ $in^3$. In yet another embodiment, a dimple having a plan shape area of about 0.030 $in^2$ may have a surface volume of about $1.40\times10^{-4}$ $in^3$ to about $1.90\times10^{-4}$ $in^3$.

Dimple Profile

In addition to varying the size of the dimples, the cross-sectional profile of the dimples may be varied. The cross-sectional profile of the dimples according to the present invention may be based on any known dimple profile shape.

In one embodiment, the profile of the dimples corresponds to a curve. For example, the dimples of the present invention may be defined by the revolution of a catenary curve about an axis, such as that disclosed in U.S. Pat. Nos. 6,796,912 and 6,729,976, the entire disclosures of which are incorporated by reference herein. In another embodiment, the dimple profiles correspond to polynomial curves, ellipses, spherical curves, saucer-shapes, truncated cones, trigonometric, exponential, or logarithmic curves and flattened trapezoids.

The profile of the dimple may also aid in the design of the aerodynamics of the golf ball. For example, shallow dimple depths, such as those in U.S. Pat. No. 5,566,943, the entire disclosure of which is incorporated by reference herein, may be used to obtain a golf ball with high lift and low drag coefficients. Conversely, a relatively deep dimple depth may aid in obtaining a golf ball with low lift and low drag coefficients.

The dimple profile may also be defined by combining a spherical curve and a different curve, such as a cosine curve, a frequency curve or a catenary curve, as disclosed in U.S. Patent Publication No. 2012/0165130, which is incorporated in its entirety by reference herein. In another embodiment, the dimple profile can result from the superposition of three or more different curves. In still another embodiment, one or more of the superposed curves can be a functionally weighted curve, as disclosed in U.S. Patent Publication No. 2013/0172123, which is incorporated in its entirety by reference herein.

Golf Ball Construction

The dimples of the present invention may be used with practically any type of ball construction. For instance, the golf ball may have a two-piece design, a double cover, or two-component dual core construction depending on the type of performance desired of the ball. Other suitable golf ball constructions include solid, wound, liquid-filled, and/or dual cores, and multiple intermediate layers.

Different materials may be used in the construction of the golf balls made with the present invention. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like.

EXAMPLES

The following non-limiting examples demonstrate golf ball dimple plan shapes made in accordance with the present invention. The examples are merely illustrative of the preferred embodiments of the present invention, and are not to be construed as limiting the invention, the scope of which is defined by the appended claims.

Examples 1-5 demonstrate various curvilinear dimple plan shapes defined by circular arcs that are derived from regular n-sided polygons. As demonstrated by the following examples, the present invention provides for a number of different visually distinct dimple plan shapes and surface textures.

Example 1

Figure 13:
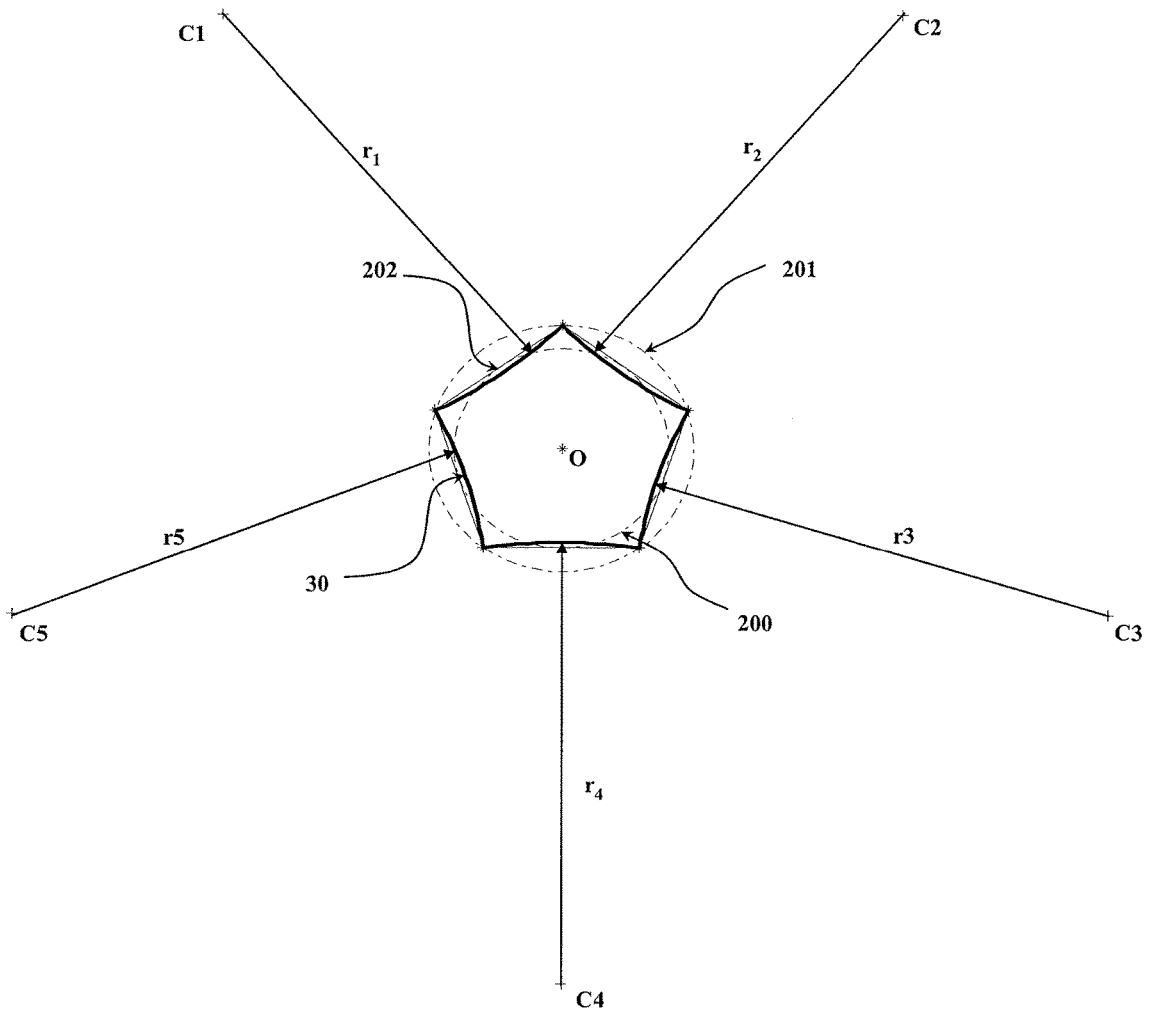
FIG. 13 illustrates a golf ball dimple plan shape defined by concave arcs that are created from the vertices of a regular 5-sided polygon according to one embodiment of the present invention.

The following example illustrates a golf ball dimple plan shape produced in accordance with the present invention. In particular, FIG. 13 illustrates a concave plan shape 30 (represented by bold line) derived from a regular five-sided polygon, or a pentagon, 202. As shown in FIG. 13, the plan shape 30 is defined by five concave arcs originating from centers C1-C5 and having equal radii, $r_i$, with respective indices 1 through 5. The circumradius 201 and inradius 200 for the pentagon 202 are illustrated as dashed lines centered about the origin, O. The dimple plan shape 30 is further defined as having a plan shape perimeter ratio of 1.0045 and a plan shape area ratio of 0.9206.

Example 2

Figure 14:
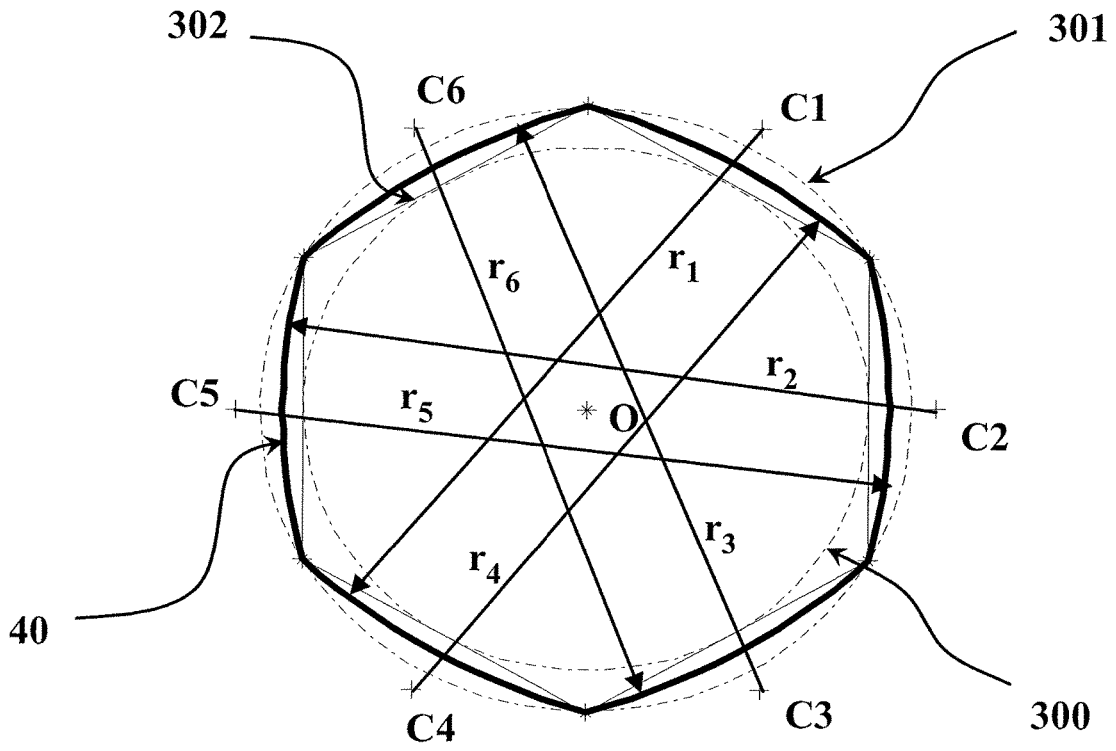
FIG. 14 illustrates a golf ball dimple plan shape defined by convex arcs that are created from the vertices of a regular 6-sided polygon according to one embodiment of the present invention.

The following example illustrates a golf ball dimple plan shape produced in accordance with the present invention. In particular, FIG. 14 illustrates a convex plan shape 40 (represented by bold line) derived from a regular six-sided polygon, or a hexagon, 302. As shown in FIG. 14, the plan shape 40 is defined by six convex arcs originating from centers C1-C6 and having equal radii, $r_i$, with respective indices 1 through 6. The circumradius 301 and inradius 300 for the hexagon 302 are illustrated as dashed lines centered about the origin, O. The dimple plan shape 40 is further defined as having a plan shape perimeter ratio of 1.0107 and a plan shape area ratio of 1.0976.

Example 3

Figure 15:
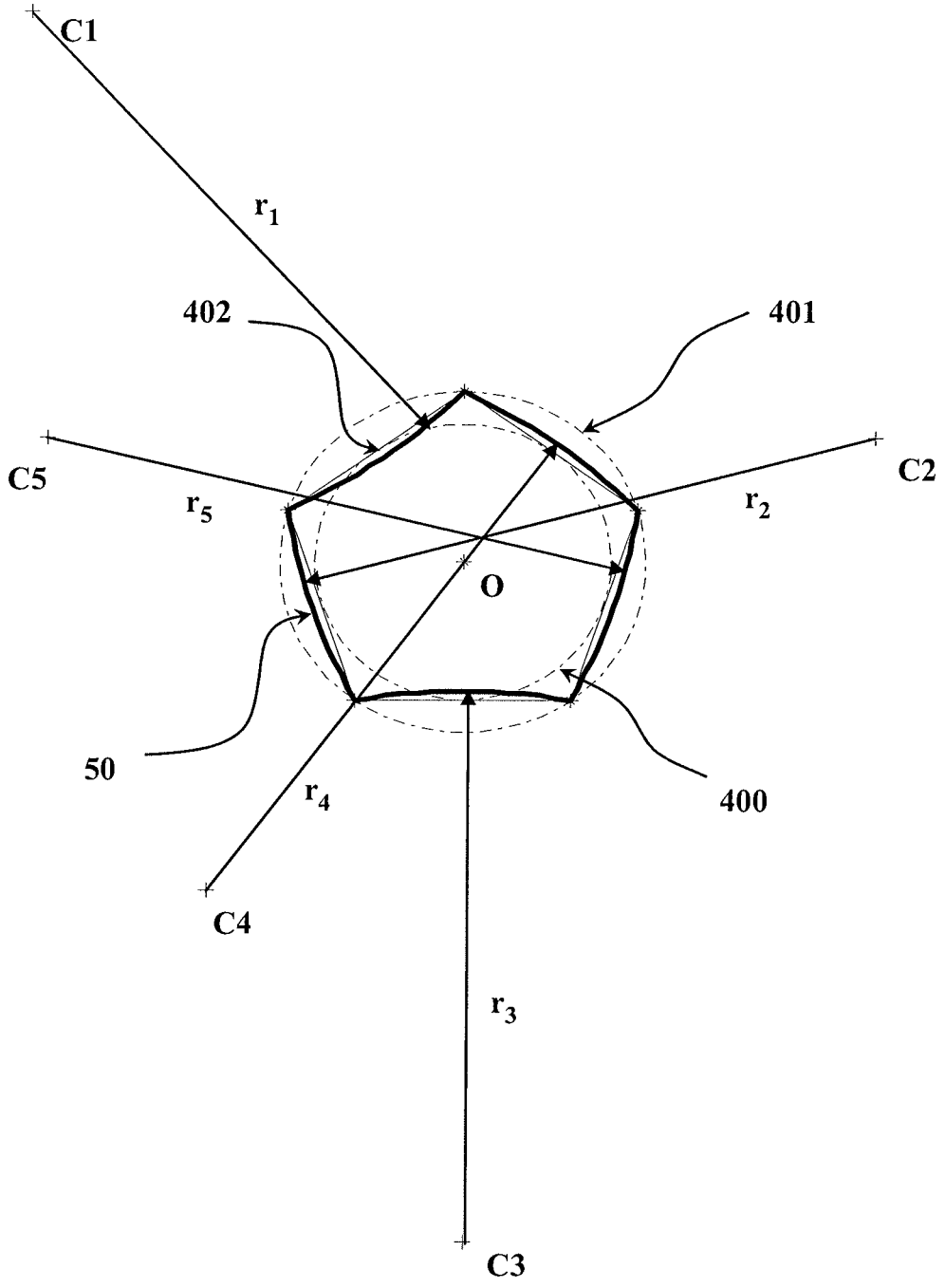
FIG. 15 illustrates a golf ball dimple plan shape defined by a random arrangement of convex and concave arcs that are created from the vertices of a regular 5-sided polygon according to one embodiment of the present invention.

The following example illustrates a golf ball dimple plan shape produced in accordance with the present invention. In particular, FIG. 15 illustrates a plan shape 50 (represented by bold line) created from a random arrangement of convex and concave arcs derived from a regular five-sided polygon, or a pentagon, 402. As shown in FIG. 15, the plan shape 50 is defined by five convex/concave arcs originating from centers C1-C5 and having equal radii, $r_i$, with respective indices 1 through 5. The circumradius 401 and inradius 400 for the pentagon 402 are illustrated as dashed lines centered about the origin, O. The dimple plan shape 50 is further defined as having a plan shape perimeter ratio of 1.0056 and a plan shape area ratio of 1.0177.

Example 4

Figure 16:
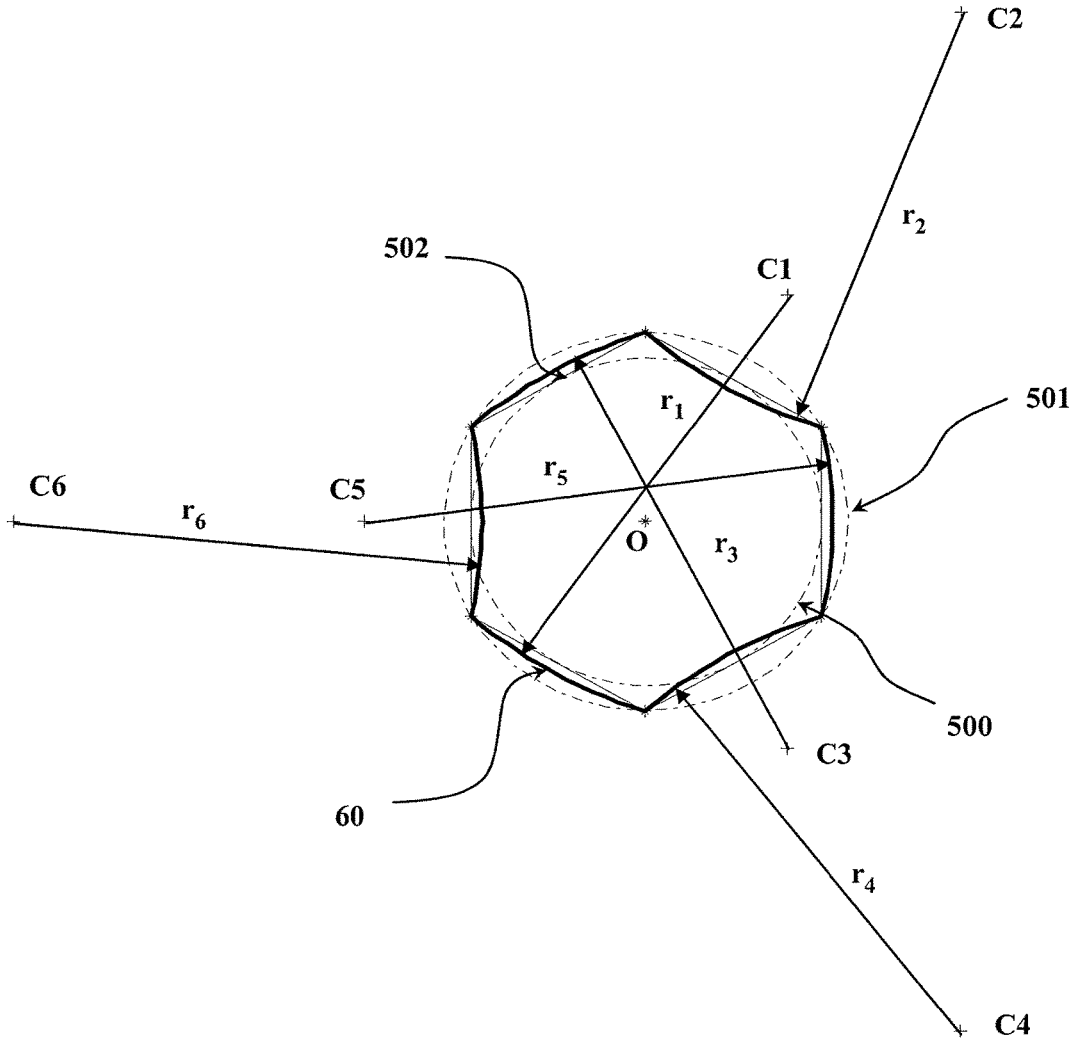
FIG. 16 illustrates a golf ball dimple plan shape defined by alternating convex and concave arcs that are created from the vertices of a regular 6-sided polygon according to one embodiment of the present invention.

The following example illustrates a golf ball dimple plan shape produced in accordance with the present invention. In particular, FIG. 16 illustrates a plan shape 60 (represented by bold line) created from alternating convex and concave arcs derived from a regular six-sided polygon, or a hexagon, 502. As shown in FIG. 16, the plan shape 60 is defined by six alternating convex and concave arcs originating from centers C1-C6 and having equal radii, $r_i$, with respective indices 1 through 6. The circumradius 501 and inradius 500 for the hexagon 502 are illustrated as dashed lines centered about the origin, O. The dimple plan shape 60 is further defined as having a plan shape perimeter ratio of 1.0079 and a plan shape area ratio of 1.000. Dimple plan shapes in accordance with this embodiment of the present invention are limited to regular n-sided polygons having an even number of sides.

Example 5

Figure 17:
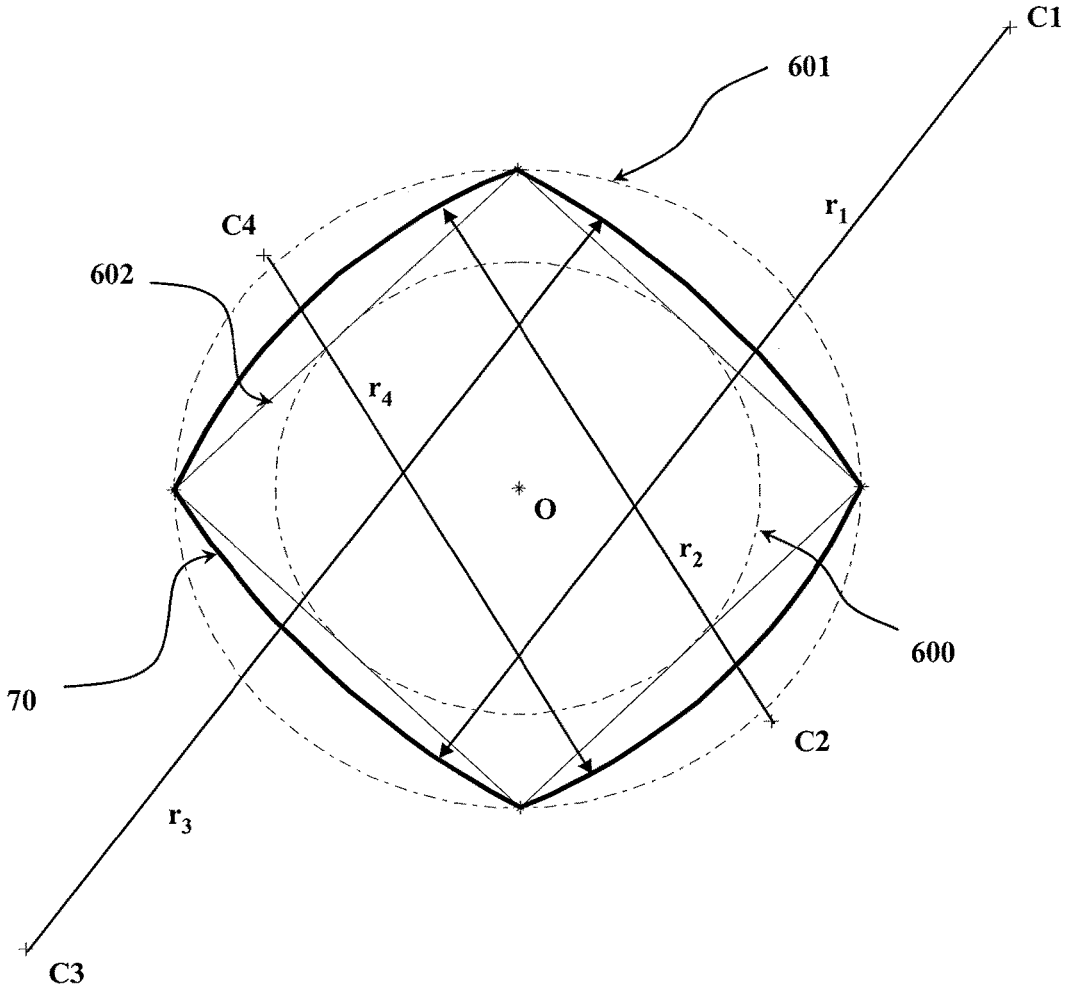
FIG. 17 illustrates a golf ball dimple plan shape defined by convex arcs having different radii that are created from the vertices of a regular 4-sided polygon according to one embodiment of the present invention.

The following example illustrates a golf ball dimple plan shape produced in accordance with the present invention. In particular, FIG. 17 illustrates a plan shape 70 (represented by bold line) created from convex arcs having different radii from a regular four-sided polygon, or a square, 602. As shown in FIG. 17, the plan shape 70 is defined by convex arcs of different radii originating from centers C1-C4 and having radii, $r_i$, with respective indices 1 through 4. In this embodiment, $r_1=r_3$ and $r_2=r_4$. The circumradius 601 and inradius 600 for the square 602 are illustrated as dashed lines centered about the origin, O. The dimple plan shape 70 is further defined as having a plan shape perimeter ratio of 1.0178 and a plan shape area ratio of 1.2144.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

What is claimed is:

1. A golf ball having a substantially spherical surface, comprising:

a plurality of dimples on the spherical surface, wherein at least a portion of the plurality of dimples comprise a non-isodiametrical plan shape defined by at least 3 circular arcs, wherein each circular arc comprises two discontinuous endpoints that define adjacent vertices of one regular polygon, and wherein each circular arc comprises an arc center outside of the regular polygon.

2. The golf ball of claim 1, wherein the non-isodiametrical plan shape is defined by 3 to 12 circular arcs.

3. The golf ball of claim 1, wherein the regular polygon is an equilateral polygon comprising from 3 to 12 sides.

4. The golf ball of claim 3, wherein the number of circular arcs is equivalent to the number of sides of the regular polygon.

5. The golf ball of claim 1, wherein the circular arcs include concave arcs, convex arcs, or combinations thereof.

6. The golf ball of claim 1, wherein the plan shape is defined by an even number of alternating convex and concave circular arcs less than or equal to 12.

7. The golf ball of claim 1, wherein at least a portion comprises about 50 percent of more of the dimples on the golf ball.

8. The golf ball of claim 1, wherein the portion of the plurality of dimples has a plan shape area ratio of about 0.35 to about 1.75.

9. A golf ball having a substantially spherical surface, comprising:

a plurality of dimples on the spherical surface, wherein at least a portion of the plurality of dimples comprise a non-isodiametrical plan shape defined by a plurality of arc segments having discontinuous endpoints that define adjacent vertices of a polygon comprising n sides, wherein each arc segment comprises an arc center outside of the polygon, and wherein the plurality of arc segments is equal to n.

10. The golf ball of claim 9, wherein the plurality of arc segments have identical lengths and radii.

11. The golf ball of claim 9, wherein n is from 3 to 12.

12. The golf ball of claim 11, wherein n is from 3 to 8.

13. The golf ball of claim 9, wherein at least a portion comprises about 70 percent of more of the dimples on the golf ball.

14. The golf ball of claim 9, wherein the plurality of arc segments comprise both concave and convex circular arcs.

15. The golf ball of claim 9, wherein the plan shape is defined by alternating convex and concave circular arcs.

16. The golf ball of claim 9, wherein the arc segments each have a different length and radius.

17. The golf ball of claim 9, wherein the portion of the plurality of dimples has a plan shape perimeter ratio of less than 1.10.

18. A golf ball dimple having a non-isodiametrical plan shape defined by a plurality of convex or concave circular arcs having identical lengths and radii, wherein each circular arc has a pair of discontinuous endpoints that define consecutive vertices of a regular n-sided polygon, wherein each circular arc comprises an arc center outside of the regular n-sided polygon, and wherein each pair of discontinuous endpoints define consecutive vertices on the same regular n-sided polygon.

19. The golf ball dimple of claim 18, wherein the perimeter of the dimple is defined by at least 3 circular arcs.

20. The golf ball dimple of claim 19, wherein the perimeter of the dimple is defined by 3 to 12 circular arcs.

21. The golf ball dimple of claim 20, wherein the regular n-sided polygon is selected from the group consisting of triangles, squares, pentagons, hexagons, heptagons, octagons, nonagons, decagons, hendecagons, and dodecagons.

22. The golf ball dimple of claim 18, wherein the perimeter is defined by a plurality of concave circular arcs and a plurality of convex circular arcs.

23. The golf ball of claim 1, wherein the regular polygon has a circumradius and an inradius, and wherein each circular arc has a radius at least twice the circumradius of the regular polygon.

24. The golf ball of claim 9, wherein the polygon is a regular polygon having a circumradius and an inradius, and wherein each arc segment has a radius at least twice the circumradius of the regular polygon.

25. The golf ball of claim 18, wherein the regular n-sided polygon has a circumradius and an inradius, and wherein each circular arc has a radius at least twice the circumradius of the regular n-sided polygon.

* * * * *